US007946896B2

(12) United States Patent
Waltz

(10) Patent No.: US 7,946,896 B2
(45) Date of Patent: May 24, 2011

(54) SUBMERSIBLE ELECTRICAL SET-SCREW CONNECTOR

(75) Inventor: Peter A. Waltz, Bristol, NH (US)

(73) Assignee: Hubbell Incorporated, Shelton, CT (US)

( * ) Notice: Subject to any disclaimer, the term of this patent is extended or adjusted under 35 U.S.C. 154(b) by 318 days.

(21) Appl. No.: 12/103,200

(22) Filed: Apr. 15, 2008

(65) Prior Publication Data

US 2008/0268721 A1 Oct. 30, 2008

Related U.S. Application Data

(60) Provisional application No. 60/927,031, filed on Apr. 30, 2007.

(51) Int. Cl.
*H01R 4/46* (2006.01)

(52) U.S. Cl. ..... 439/810; 439/798; 439/587; 411/373; 411/377

(58) Field of Classification Search ..... 439/798, 439/810–814, 521, 587; 411/373, 377
See application file for complete search history.

(56) References Cited

U.S. PATENT DOCUMENTS

| | | | | | |
|---|---|---|---|---|---|
| 1,312,409 | A * | 8/1919 | Miller et al. | ..... | 411/399 |
| 3,134,290 | A * | 5/1964 | Jentoft | ..... | 411/377 |
| 3,693,495 | A * | 9/1972 | Wagner | ..... | 411/377 |
| 4,154,138 | A * | 5/1979 | Melone | ..... | 411/373 |
| 4,235,147 | A * | 11/1980 | Weidner, Jr. | ..... | 411/396 |
| 4,266,460 | A * | 5/1981 | Klimowicz | ..... | 411/397 |
| 5,122,021 | A * | 6/1992 | Medal | ..... | 411/377 |
| 5,533,913 | A | 7/1996 | Boehm et al. | ..... | 439/810 |
| 6,074,591 | A | 6/2000 | Privett | ..... | 264/278 |
| 6,764,354 | B2 * | 7/2004 | Kaine et al. | ..... | 439/793 |
| 6,811,365 | B2 * | 11/2004 | Monson | ..... | 411/395 |
| 7,311,563 | B2 * | 12/2007 | Siebens et al. | ..... | 439/781 |
| 2003/0087552 | A1 | 5/2003 | Borgstrom et al. | ..... | 439/590 |
| 2006/0155280 | A1 | 7/2006 | Siebens et al. | ..... | 606/61 |

OTHER PUBLICATIONS

2007 Burndy Mater Catalog, pp. A-46 to A-51.

* cited by examiner

*Primary Examiner* — Xuong M Chung Trans

(74) *Attorney, Agent, or Firm* — Harrington & Smith

(57) ABSTRACT

Disclosed herein is an electrical connector set-screw. The electrical connector set-screw includes a body part and a head part. The body part includes a threaded section and a channel. The threaded section extends between a first end and an opposite second end of the body part. The channel extends through a portion of the body part. The channel is spaced from the first end and the second end of the body part The head part is connected to the body part. The head part includes a top section and an integral locking section. The top section is configured to be received by a tool. The integral locking section extends through the channel.

25 Claims, 6 Drawing Sheets

SUBMERSIBLE ELECTRICAL SET-SCREW CONNECTOR

CROSS REFERENCE TO RELATED APPLICATION

This application claims priority under 35 U.S.C. §119(e) to U.S. provisional patent application No. 60/927,031 filed Apr. 30, 2007 which is hereby incorporated by reference in its entirety.

BACKGROUND OF THE INVENTION

1. Field of the Invention

The invention relates to an electrical connector and, more particularly, to a submersible electrical set-screw connector.

2. Brief Description of Prior Developments

Submersible electrical set-screw connectors for making connections in power distribution networks are known in the art. U.S. Pat. No. 6,764,354 B2, which is hereby incorporated by reference in its entirety, discloses a submersible electrical set-screw connector. A similar insulated water-tight connector assembly including a set screw driver and plug is disclosed in U.S. Patent Publication No. 2006/0155280 A1 which is hereby incorporated by reference in its entirety. These conventional connectors provide set-screw assemblies having various configurations. There is a problem in that the electrical connections within these conventional configurations may become compromised as electrical utility operating environments become more severe and demanding.

Accordingly, there is need to for an improved submersible electrical set-screw connector.

SUMMARY OF THE INVENTION

In accordance with one aspect of the invention, an electrical connector set-screw is disclosed. The electrical connector set-screw includes a body part and a head part. The body part includes a threaded section and a channel. The threaded section extends between a first end and an opposite second end of the body part. The channel extends through a portion of the body part. The channel is spaced from the first end and the second end of the body part. The head part is connected to the body part. The head part includes a top section and an integral locking section. The top section is configured to be received by a tool. The integral locking section extends through the channel.

In accordance with another aspect of the invention, a submersible electrical set-screw connector is disclosed. The submersible electrical set-screw connector includes a connector body section and a set-screw assembly. The connector body section includes a first opening and a second opening. The first opening is substantially perpendicular to the second opening. The first opening is configured to receive a portion of an electrical conductor. The set-screw assembly is fastened to the connector body section at the second opening. The set-screw assembly includes a body part and a head part. The body part includes a threaded section and a first channel. The first channel extends in a direction substantially transverse to a central axis of the threaded section. The head part includes a top section and an integral locking section. The top section is configured to be received by a tool. The integral locking section extends through the first channel.

In accordance with yet another aspect of the invention, a method of manufacturing an electrical connector set-screw is disclosed. A body part having a threaded section and a channel is provided. The threaded section extends between a first end and an opposite second end of the body part. The channel extends through a portion of the body part. The channel is spaced from the first end and the second end of the body part. A head part is molded over a portion of the body part. The head part includes a top section configured to be received by a tool. A portion of the head part extends through the channel.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
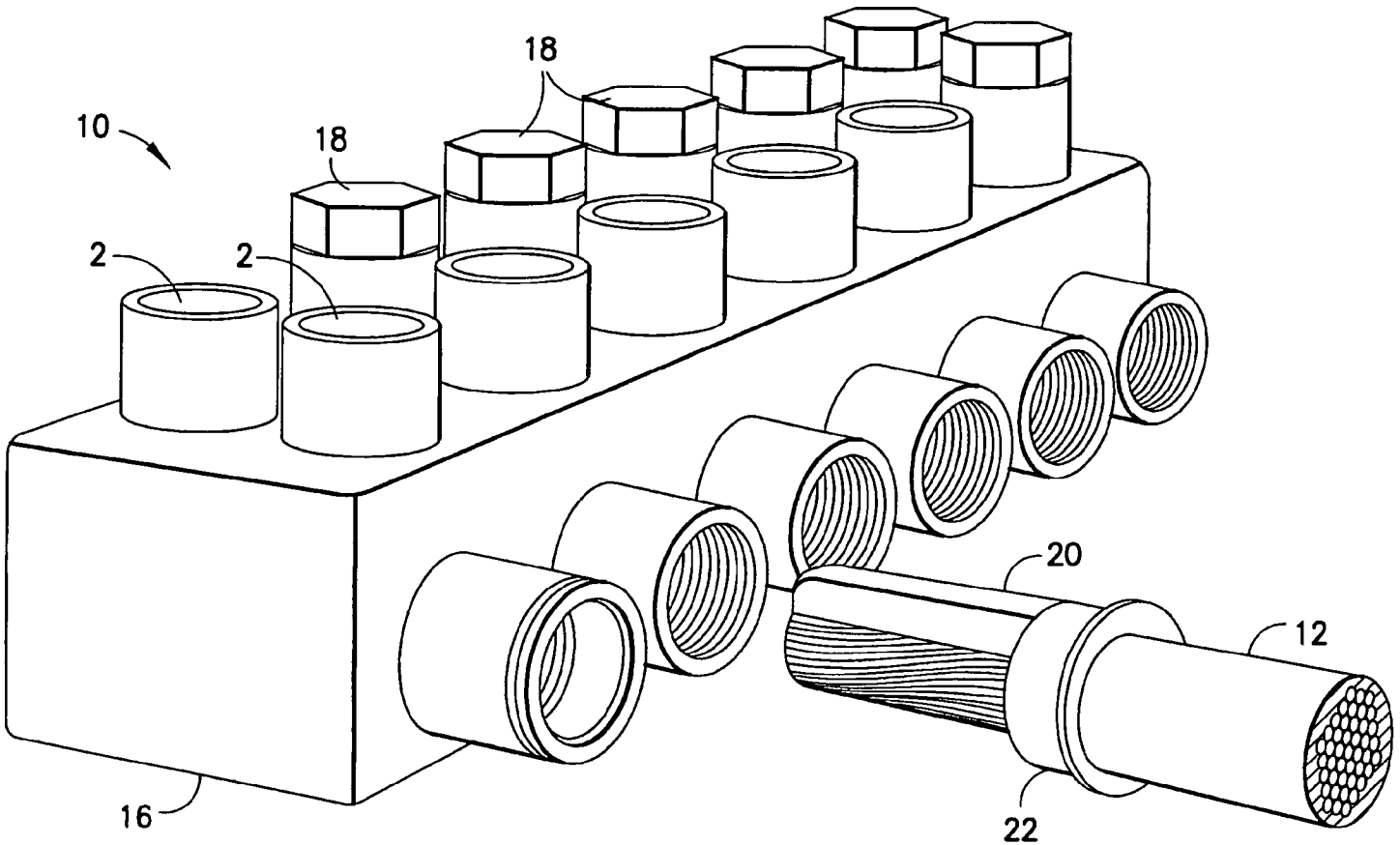
FIG. 1 is a perspective view of a submersible electrical set-screw connector comprising features of the invention.

Referring to FIG. 1, there is shown a perspective view of a submersible electrical set-screw connector 10 incorporating features of the invention, intended to be used to connect multiple electrical conductors 12 (only one of which is shown) to each other. Although the invention will be described with reference to the exemplary embodiments shown in the drawings, it should be understood that the invention can be embodied in many alternate forms of embodiments. In addition, any suitable size, shape or type of elements or materials could be used.

Figure 2:
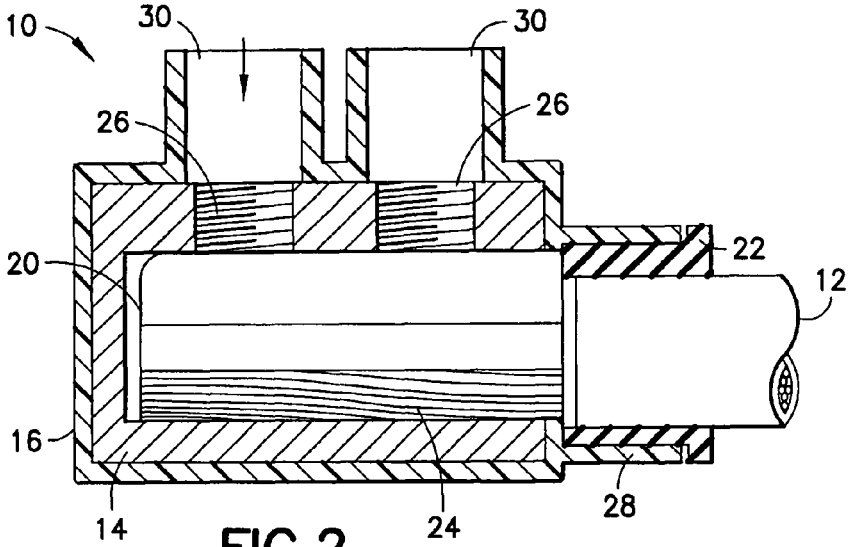
FIG. 2 is a cross section view of the submersible electrical set-screw connector shown in FIG. 1.
Figure 3:
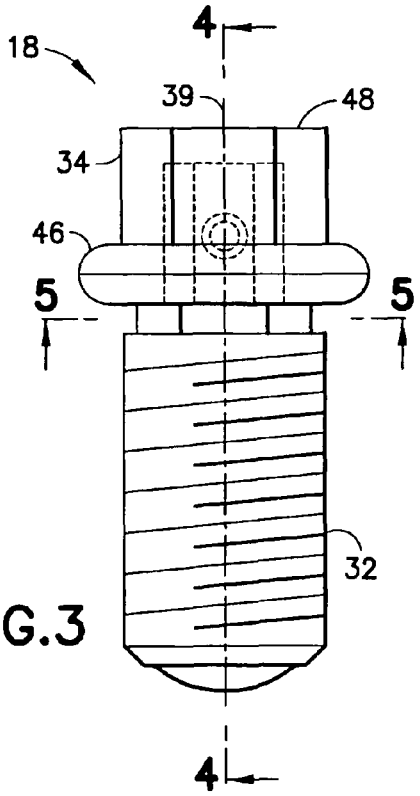
FIG. 3 is a front view of a set-screw assembly used in the submersible electrical set-screw connector shown in FIG. 1.
Figure 4:
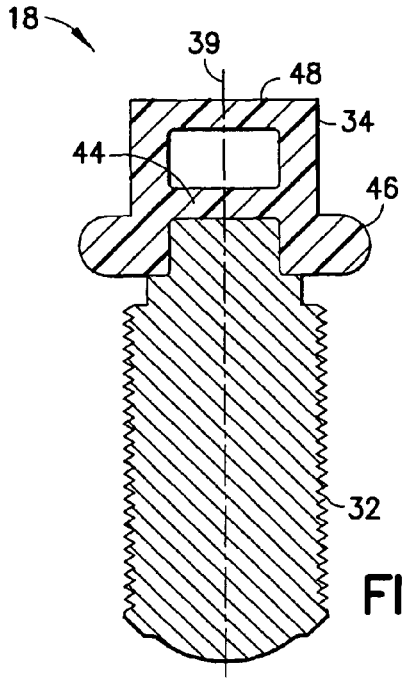
FIG. 4 is a cross section view of the set-screw assembly shown in FIG. 3.
Figure 5:
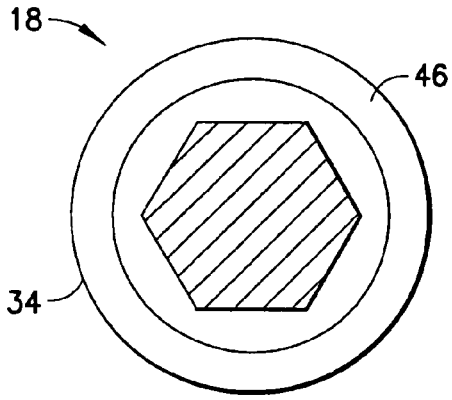
FIG. 5 is another a cross section view of the set-screw assembly shown in FIG. 3.
Figure 6:
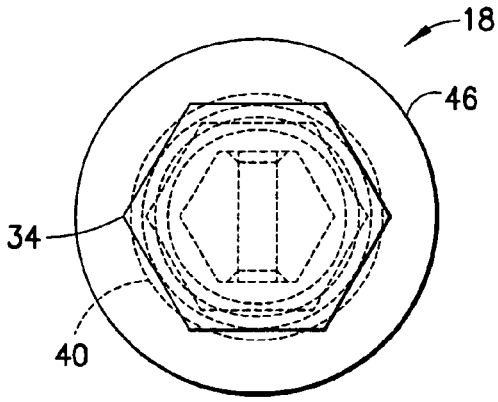
FIG. 6 is a top plan view of the set-screw assembly shown in FIG. 3.
Figure 7:
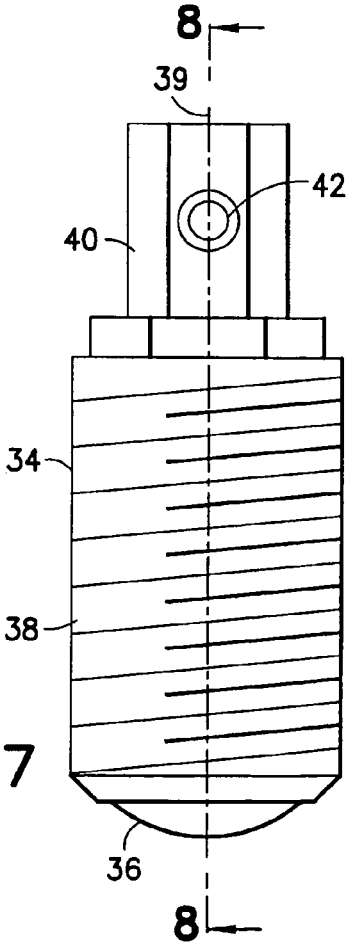
FIG. 7 is a front view of a head part of the set-screw assembly shown in FIG. 3.
Figure 8:
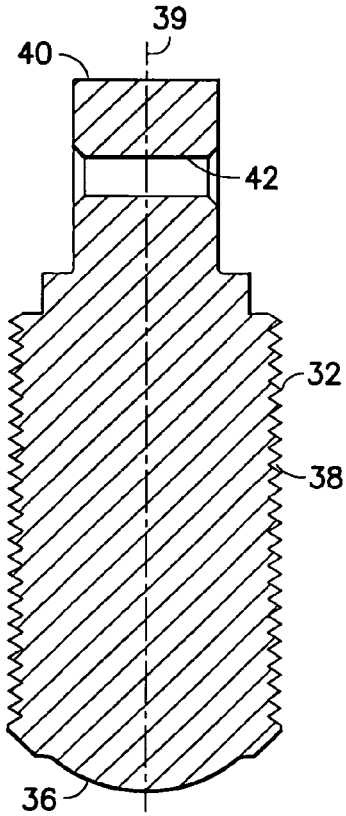
FIG. 8 is a cross section view of the head part shown in FIG. 7.
Figure 9:
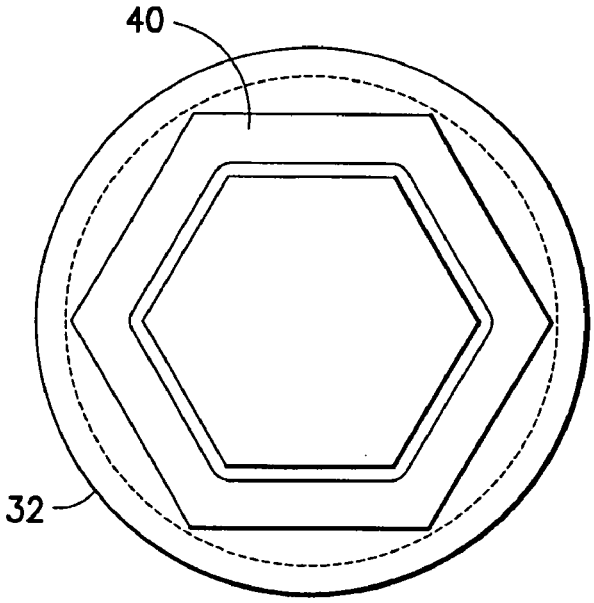
FIG. 9 is a top plan view of the head part shown in FIG. 7.
Figure 10:
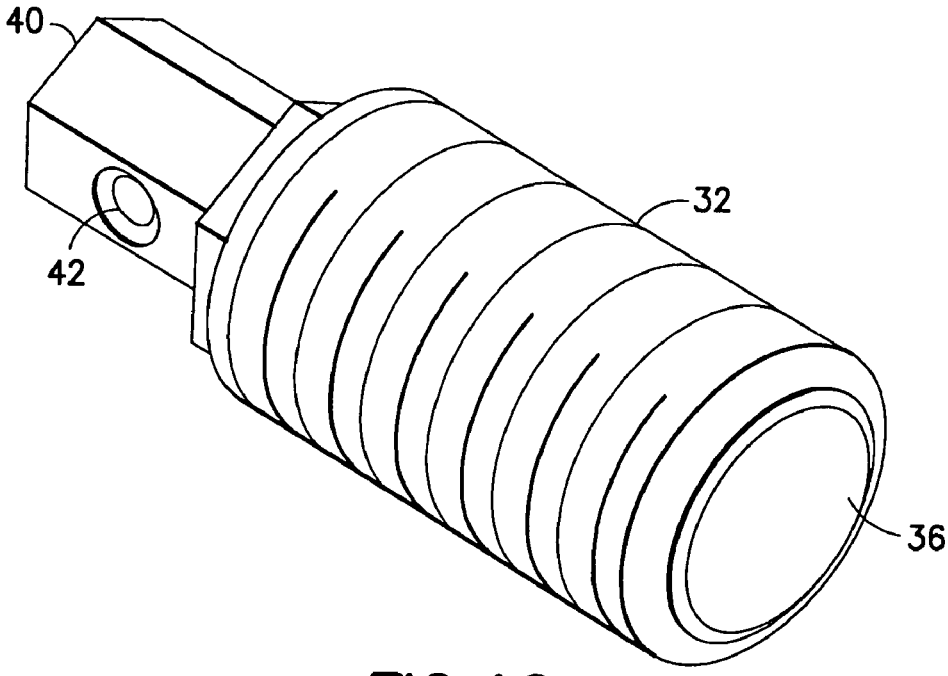
FIG. 10 is a perspective view of the head part shown in FIG. 7.

Referring also to FIG. 2, the connector 10 generally comprises a body 14, a cover 16, set screw assemblies 18, adapters 20, and sealing members 22. In an alternate embodiment the adapters 20 might not be provided. The connector might also include sealing plugs (not shown) to cover unused holes in the connector. The body, or connector body section, 14 is comprised of electrically conductive material, such as aluminum for example. The body 14 has holes (or openings) 24 for receiving the conductors 12. The body 14 also has holes (or openings) 26 for receiving the set screw assemblies 18. The holes 24 are substantially perpendicular to the holes 26. However, alternate embodiments may comprise any suitable configuration. The cover 16 is preferably overmolded onto the body 14. The cover is comprised of an electrically insulating material such as a polymer material. The cover 16 has holes (or openings) 28 for receiving the conductors 12 and the sealing members 22. The cover 16 also has holes (or openings) 30 for receiving the set screw assemblies 18. The holes 28 are substantially perpendicular to the holes 30. However, alternate embodiments may comprise any suitable configuration.

Referring also to FIGS. 3-6, each of the set screw assemblies 18 generally comprise a screw body 32 and a screw head 34. Referring also to FIGS. 7-10, the screw body, or body part, 32 is preferably comprised of metal and comprises a first end 36 for contacting the conductor 12 or the adapter 20, a threaded shaft (or threaded section) 38 and a second end 40. The second end 40 has a general hexagon shape with a channel 42 therein. The channel 42 extends in a direction substantially transverse to a central axis 39 of the threaded section 38.

The screw head 34 is preferably comprised of an electrically insulating material, such as a molded plastic or polymer material. The screw head 34 is preferably overmolded onto the second end 40 of the screw body 32. During overmolding, material forming the screw head 34 extends into the channel 42 and surrounds a portion of an outer surface of the second end 42. This interlocks the screw head 34 onto the screw body 32 as a non-removable connection forms the screw body 32 and the screw head 34 into a one-piece member. In an alternate embodiment the connection might be removable, such as if the screw head is connected to the screw body after the screw head is formed.

The screw head, or head part, 34 generally comprises a locking section 44 located in the channel 42, a sealing ring section 46, and a top hexagon section 48. The locking section 44 is integrally formed with the screw head 34 during the overmolding. The top hexagon section 48 is aligned with the hexagon shape of the second end 40 of the screw body 32 such that the material of the screw head 34 at the top hexagon section 48 has a substantially uniform thickness. During overmolding, the screw body 32 is precisely located in one of six positions in the molding device to align the hexagon shapes. The uniform thickness of the material at the top hexagon section 48 provides the benefit of better strength of the section 48 and helps to prevent cracks from developing. The hexagon shape is provided for a hexagon shaped tool or a wrench to screw the set screw assembly 18 into the body 14 and cover 16. In alternate embodiments, other shapes could be provided.

When the set screw assembly 18 is inserted into one of the holes 30, 26, the threaded shaft 38 can thread into the threaded hole 26 and the sealing ring section 46 can make a sealing engagement with the cover 16.

Figure 11:
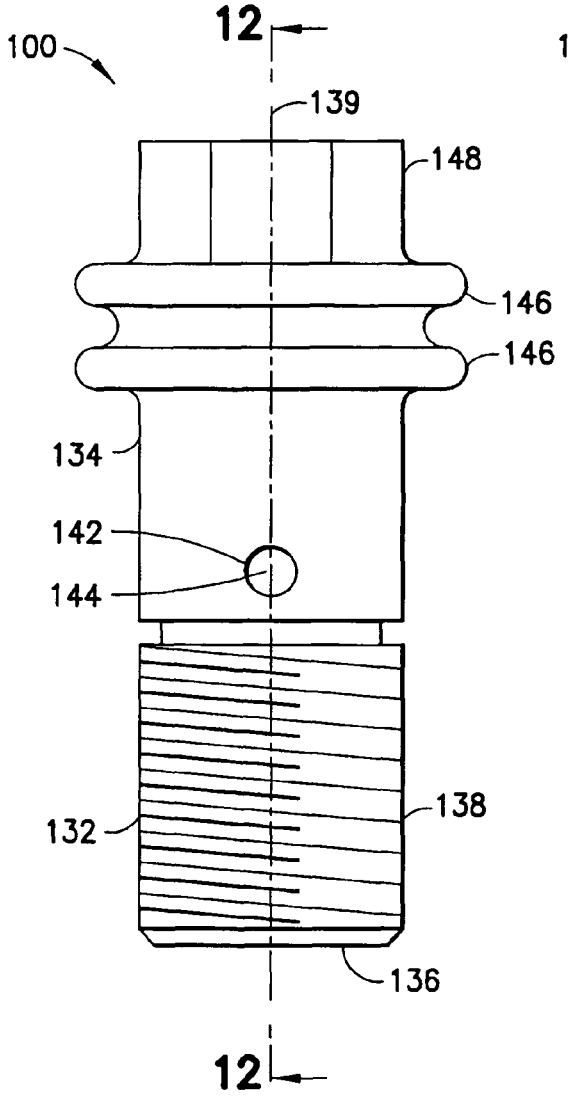
FIG. 11 is a front view of an alternative set-screw assembly used in the submersible electrical set-screw connector shown in FIG. 1.
Figure 12:
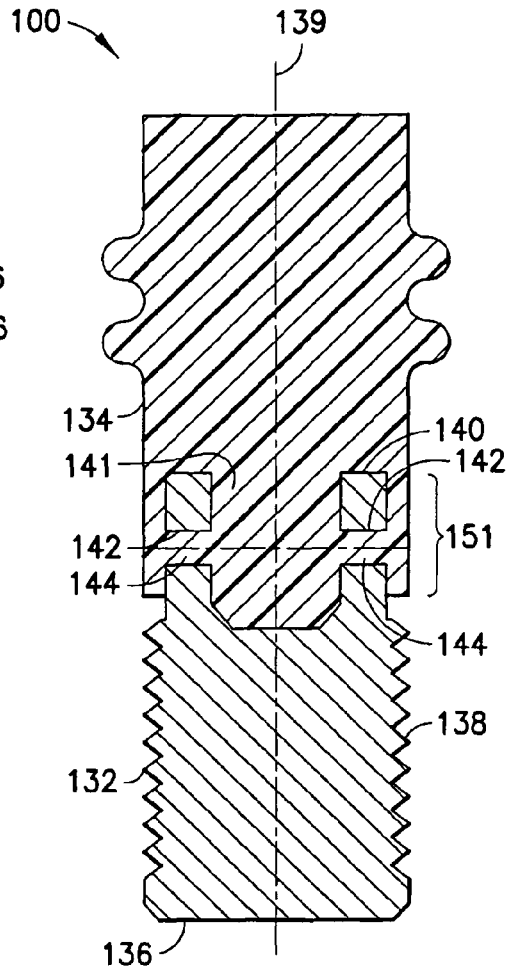
FIG. 12 is a cross section view of the set-screw assembly shown in FIG. 11.

Referring also to FIGS. 11-12, one alternate embodiment of a set-screw assembly 100 is shown. Similar to the set-screw assembly 18, the set-screw assembly 100 comprises a screw body 132 and a screw head 134.

The screw body, or body part, 132 is preferably comprised of metal and comprises a first end 136 for contacting the conductor 12 or the adapter 20, a threaded shaft (or threaded section) 138 and a second end 140. The second end 140 may have a general hexagon shape. However, any suitable shape may be provided. The second end further comprises an opening 141 and channels 142. The channels 142 extend radially from the opening 141 to an outer surface of the body part 132. The channels 142 extend in a direction substantially transverse to a central axis 139 of the threaded section 138. Additionally, the channels 142 extend in a direction substantially perpendicular to the opening 141. Similar to the set-screw assembly 18, the second end 140 comprises a smaller diameter than the threaded shaft 138. However, any suitable configuration may be provided.

The screw head 134 is preferably comprised of an electrically insulating material, such as a molded plastic or polymer material. The screw head 134 1s preferably overmolded onto the second end 140 of the screw body 132. During overmolding, material forming the screw head 134 extends through the opening 141 and into the channels 142, and surrounds a portion of an outer surface of the second end 142. This interlocks the screw head 134 onto the screw body 132 as a non-removable connection forms the screw body 132 and the screw head 134 into a one-piece member. In an alternate embodiment the connection might be removable, such as if the screw head is connected to the screw body after the screw head is formed. It should be noted that although the figures illustrate two channels 142, any suitable number of channels may be provided.

The screw head, or head part, 134 generally comprises locking sections 144 located in the channels 142, sealing ring sections (or sealing flanges) 146, and a top hexagon section 148. The locking sections 144 are integrally formed with the screw head 134 during the overmolding. Although the figures illustrate the top section 148 as having a hexagon shape, any suitable shape for engaging with a tool may be provided. For example, the top section may comprise a torx or square shape. Additionally, the insulation to metal drive area 151 may comprise any suitable shape such as a hex, torx, or square shape (with cross holes/channels) for example.

Figure 13:
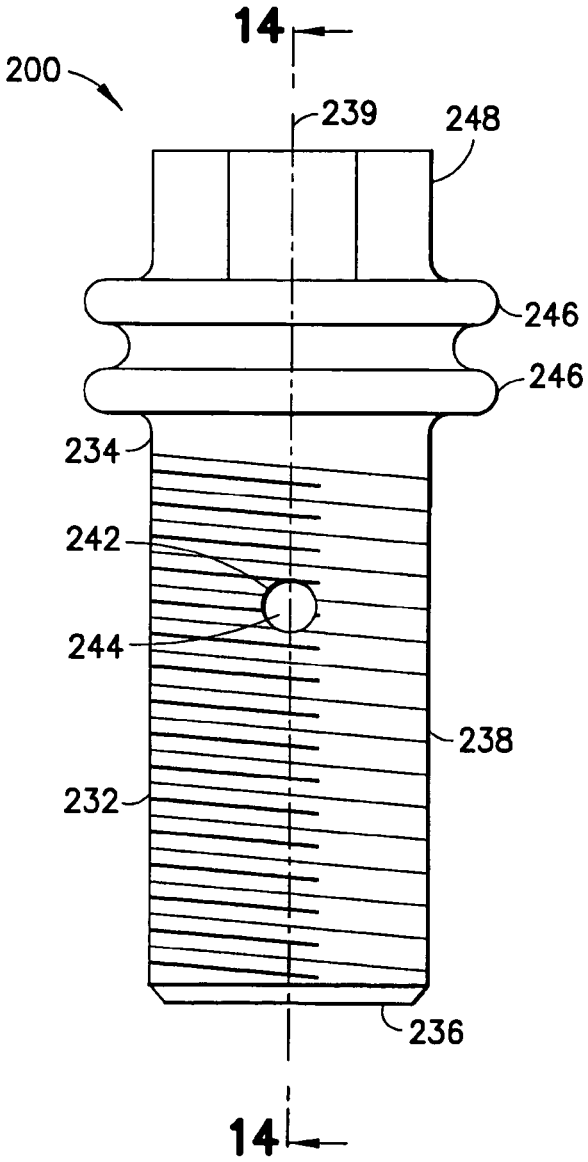
FIG. 13 is a front view of another alternative set-screw assembly used in the submersible electrical set-screw connector shown in FIG. 1.
Figure 14:
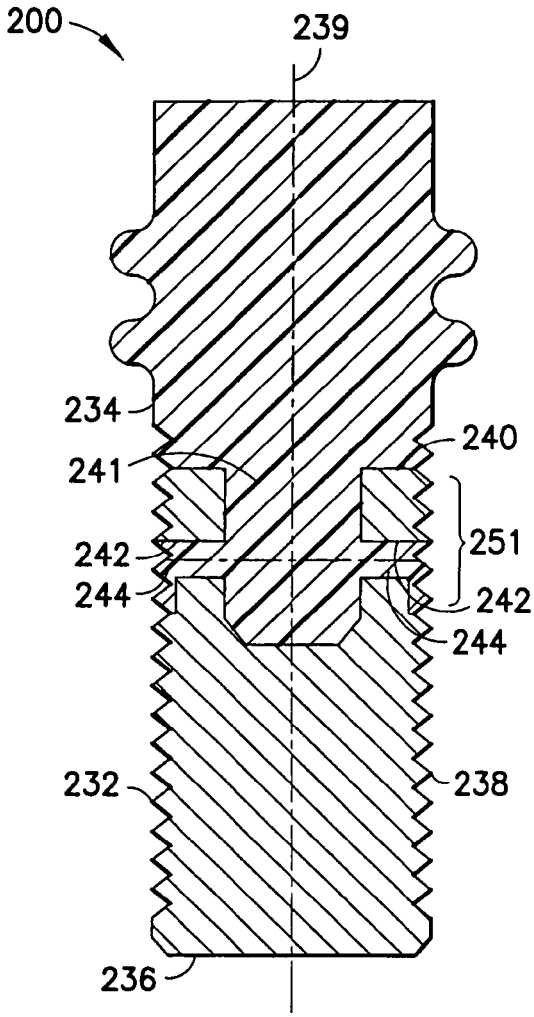
FIG. 14 is a cross section view of the set-screw assembly shown in FIG. 13.

Referring also to FIGS. 13-14, another alternate embodiment of a set-screw assembly 200 is shown. Similar to the set-screw assemblies 18, 100 the set-screw assembly 200 comprises a screw body 232 and a screw head 234.

The screw body, or body part, 232 is preferably comprised of metal and comprises a first end 236 for contacting the conductor 12 or the adapter 20, a threaded shaft (or threaded section) 238 and a second end 240. The second end 240 may have a general hexagon shape. However, any suitable shape may be provided. The second end further comprises an opening 241 and channels 242. The channels 242 extend radially from the opening 241 to an outer surface of the body part 232. The channels 242 extend in a direction substantially transverse to a central axis 239 of the threaded section 238. Additionally, the channels 242 extend in a direction substantially perpendicular to the opening 241. In this embodiment, the second end 240 comprises substantially the same diameter as that of the threaded shaft 238. Additionally, the threaded section may extend the full length of the body part 232 between the first end 236 and the second end 240. However, any suitable configuration may be provided.

The screw head 234 is preferably comprised of an electrically insulating material, such as a molded plastic or polymer material. The screw head 234 is preferably overmolded onto the second end 140 of the screw body 232. During overmolding, material forming the screw head 134 extends through the opening 141 and into the channels 142. The material extending through the opening also extends from an end portion of the screw head 234 in a general cantilever fashion. This interlocks the screw head 234 onto the screw body 232 as a non-removable connection forms the screw body 232 and the screw head 234 into a one-piece member. In an alternate embodiment the connection might be removable, such as if the screw head is connected to the screw body after the screw head is formed. It should be noted that although the figures illustrate two channels 242, any suitable number of channels may be provided.

The screw head, or head part, 234 generally comprises locking sections 244 located in the channels 242, sealing ring sections (or sealing flanges) 246, and a top hexagon section 248. The locking sections 244 are integrally formed with the screw head 234 during the overmolding. Although the figures illustrate the top section 248 as having a hexagon shape, any suitable shape for engaging with a tool may be provided. For example, the top section may comprise a torx or square shape. Additionally, the insulation to metal drive area 251 may comprise any suitable shape such as a hex, torx, or square shape (with cross holes/channels) for example. Additionally, as shown in FIG. 14, the screw head 234 may comprise a threaded section adjacent the threaded shaft 238. However, any suitable configuration may be provided.

With embodiments of the invention, a screw with an insulated head/seal flange and a metal threaded body can be provided. The purpose of the screw is to replace the existing metal screw and insulating sealing cap (two components) with a single component that clamps the conductor, provides insulation and provides sealing.

Some existing attempts of insulating/sealing head screws are made completely from plastic materials. These existing attempts have failed as the plastic threads have yielded when the connector reaches operating temperature, and the electrical connection is compromised. With the insulating head and metal thread of the invention, the metal threads do not yield when the connector reaches operating temperature, and the electrical connection is not compromised. The insulating head is only torqued when it is at room temperature; where the properly selected insulating material will not fail.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector set-screw comprising;

a body part comprising a threaded section and a channel, wherein the threaded section extends in a first direction between a first end and an opposite second end of the body part, wherein the channel extends through a portion of the body part, and wherein the channel is spaced from the first end and the second end of the body part; and a head part connected to the body part, wherein the head part comprises a top section, a ring section, and an integral locking section, wherein the top section is configured to be received by a tool, wherein the ring section is configured to make a sealing engagement with a surface extending substantially parallel to the first direction, and wherein the integral locking section extends through the channel.

2. The electrical connector set-screw of claim 1 wherein the body part comprises a metal material.

3. The electrical connector set-screw of claim 1 wherein the head part comprises a threaded section, and wherein the head part comprises a polymer material.

4. The electrical connector set-screw of claim 1 wherein the head part is overmolded onto the body part.

5. The electrical connector set-screw of claim 1 wherein the body part comprises a metal material, and wherein the head part comprises a polymer material.

6. The electrical connector set-screw of claim 5 wherein the head part is overmolded onto the body part.

7. The electrical connector set-screw of claim 6 wherein the channel extends in a direction substantially transverse to a central axis of the threaded section.

8. The electrical connector set-screw of claim 1 wherein the body part further comprises an opening, wherein a portion of the head part extends into the opening, wherein the ring section comprises a first sealing flange and a second sealing flange, and wherein the first sealing flange and the second sealing flange are configured to make sealing engagements with the surface extending substantially parallel to the first direction.

9. The electrical connector set-screw of claim 8 wherein the channel extends from the opening to an outer surface of the body part.

10. The electrical connector set-screw of claim 8 wherein the channel is substantially perpendicular to the opening.

11. A submersible electrical set-screw connector comprising:

a connector body section comprising a first opening and a second opening, wherein the first opening is substantially perpendicular to the second opening, and wherein the first opening is configured to receive a portion of an electrical conductor; and an electrical connector set-screw as in claim 1 threadably connected to the connector body section at the first opening.

12. A submersible electrical set-screw connector comprising:

a connector body section comprising a first opening and a second opening, wherein the first opening is substantially perpendicular to the second opening, and wherein the first opening is configured to receive a portion of an electrical conductor; and a set-screw assembly fastened to the connector body section at the second opening, wherein the set-screw assembly comprises a body part and a head part, wherein the body part comprises a threaded section and a first channel, wherein the first channel extends in a direction substantially transverse to a central axis of the threaded section, wherein the head part comprises a top section, a sealing ring section, and an integral locking section, wherein the top section is configured to be received by a tool, wherein the sealing ring section extends from the top section in the direction substantially transverse to the central axis of the threaded section, wherein the sealing ring section is configured to contact a surface of the connector spaced from the second opening, and wherein the integral locking section extends through the first channel.

13. The submersible electrical set-screw connector of claim 12 wherein the head part is overmolded onto the body part.

14. The submersible electrical set-screw connector of claim 12 wherein the body part comprises a metal material.

15. The submersible electrical set-screw connector of claim 14 wherein the head part comprises a plastic material.

16. The submersible electrical set-screw connector of claim 12 wherein the body part further comprises a second channel opposite the first channel.

17. The submersible electrical set-screw connector of claim 16 wherein the body part further comprises an opening between the first channel and the second channel.

18. The submersible electrical set-screw connector of claim 17 wherein a portion of the head part extends into the opening of the body part.

19. The submersible electrical set-screw connector of claim 17 wherein the integral locking section extends between the opening of the body part and an outer surface of the body part.

20. The submersible electrical set-screw connector of claim 12 wherein the connector body section comprises a body and an electrically insulating material, wherein the electrically insulating material surrounds the body, and wherein the sealing section is configured to contact a surface of the electrically insulating material.

21. The submersible electrical set-screw connector of claim 12 wherein the body part and the head part form a one-piece member.

22. A method of manufacturing an electrical connector set-screw comprising:

providing a body part having a threaded section and a channel, wherein the threaded section extends between a first end and an opposite second end of the body part, wherein the channel extends through a portion of the body part, and wherein the channel is spaced from the first end and the second end of the body part; and molding a head part over a portion of the body part, wherein the head part comprises a top section and a sealing ring section, wherein the top section is configured to be received by a tool, wherein the sealing ring section extends beyond the top section in a direction substantially perpendicular to a central axis of the threaded section, wherein the sealing ring section is configured to make a sealing engagement with an opening of a connector, and wherein a portion of the head part extends through the channel.

23. The method of claim 22 wherein the molding of the head part over a portion of the body part further comprises overmolding the head part on to an end of the body part, and wherein the opening of the connector further comprises an opening of a cover of the connector.

24. The method of claim 22 wherein the molding of the head part over a portion of the body part further comprises integrally locking the head part onto the body part.

25. The method of claim 22 wherein the body part comprises another channel, and wherein a portion of the head part extends through the another channel.

* * * * *